United States Patent [19]

Chan

[11] Patent Number: 5,001,617

[45] Date of Patent: Mar. 19, 1991

[54] SELF-BALANCED, MULTIPOSITION HOLDER

[76] Inventor: Erik Chan, 2 Bryant St., San Francisco, Calif. 94105

[21] Appl. No.: 367,034

[22] Filed: Jun. 16, 1989

[51] Int. Cl.[5] ..... F21V 21/20

[52] U.S. Cl. ..... 362/401; 362/413; 362/418; 362/269

[58] Field of Search ..... 362/389, 401, 410, 413, 362/418, 806, 269

[56] References Cited

U.S. PATENT DOCUMENTS

| | | | |
|---|---|---|---|
| 1,228,615 | 6/1917 | Stafford | 362/401 |
| 3,247,370 | 4/1966 | Lynn | 362/410 |
| 3,330,950 | 7/1967 | Lawson et al. | 362/401 |
| 3,790,773 | 2/1974 | Sapper | 362/401 |
| 3,790,773 | 2/1974 | Sapper | 240/81 |
| 4,028,543 | 6/1977 | Oster | 240/52.1 |
| 4,706,172 | 11/1987 | Lebowitz | 362/413 |

FOREIGN PATENT DOCUMENTS

| | | | |
|---|---|---|---|
| 212150 | 1/1958 | Australia | 362/401 |
| 714784 | 11/1931 | France | 362/410 |
| 313174 | 7/1930 | United Kingdom | 362/410 |

*Primary Examiner*—Ira S. Lazarus
*Assistant Examiner*—Sue Hagarman
*Attorney, Agent, or Firm*—David Pressman

[57] ABSTRACT

A self-balanced multiposition holder (10), particularly for a lamp (16) comprises a circular sector-like base (12) and an arm (14) attached to the base. At its end opposite to the lamp, the arm is attached to a counterweight (20), which in assembled state of the unit is hidden inside the base. The center of gravity of the entire unit is located at the center of the circle of the above-mentioned sector which forms the base, and the weight of the base, together with the counterweight is balanced by the weight of the arm with the lamp shade and lamp. Thus, when the holder is inclined at any position by rolling it on the circular bottom surface of the base, it remains at equilibrium in any position within its range of rotation.

19 Claims, 4 Drawing Sheets

SELF-BALANCED, MULTIPOSITION HOLDER

BACKGROUND—FIELD OF THE INVENTION

The present invention relates to a self-balanced, multiposition holder for various objects, particularly to a desk or floor lamp which can remain stably in any required position without the use of any moveable parts.

BACKGROUND—DESCRIPTION OF THE PROBLEM AND PRIOR ART

A great variety of holders for various objects which can be installed in many selected positions are known and find application in many fields. Although many objects can be supported by such holders, they will be described and exemplified with reference to desk or floor lamps since these are the preferred embodiments of the invention.

U.S. Pat. No. 1,228,615 to M. A. Stafford, 1917, describes a lamp signal guide post with a heavy curved base and an extended arm attached to the base and carrying a signal lamp. The center of gravity of the unit is located close to the bottom of the base, so that the holder works in the nature of "roly-poly man," i.e., it always tends to assume a vertical position, even if tipped over. In other words, a holder of this type has only one stable vertical position and cannot be installed in any position where its arm is inclined.

U.S. Pat. No. 3,790,773 to R. Sapper, 1974, describes a lamp with an articulated support comprising a stem and a plurality of pivotally connected links. A lamp is mounted on one terminal link and a counterweight is mounted on the opposite terminal link. The lamp can be installed in any required position and is balanced by its counterweight. The disadvantages of this articulated lamp holder are that it has many moving parts and occupies a large space because its counterweight projects on the side opposite the arm which carries the lamp. Also, the lamp is rather expensive to manufacture.

Australian patent No. 212,150 to Iggulden, 1958, shows a lamp comprising a head, an elongated arm, and a counterweight at the other end of the arm. The counterweight is pivoted on a stand so that the lamp can be adjusted in any position and will retain itself by means of its balancing counterweight. Although this lamp holder has self-balancing features, it has moving parts, i.e., the unit consisting of the arm, lamp, and the counterweight is pivotally rotated with regard to the stand. Such moving parts are disadvantageous because of their cost; also they detract from a "clean" aesthetic look. Also, the lamp requires additional space for the moveable counterbalance. The stand is stationary and cannot change its position.

All of the lamp holders described above (except for the roly-poly type, which is self-balanced, but only in a vertical position), cannot be self-balanced in various positions of support with respect to their supporting surface, i.e., of the floor or table top. Therefore, if they are subjected to shaking, e.g., in case of accidental bumps or an earthquake, these lamps will lose their balance and fall down.

OBJECTS AND ADVANTAGES OF THE INVENTION

It is accordingly an object of the invention to provide a self-balanced lamp or holder for various objects, including a lamp, which is simple in construction, inexpensive to manufacture, free of any moving or pivoting parts, can be stably installed in any desired position within a given range, and has an attractive appearance. Another object is to provide a holder or lamp which will not fall down in case of occasional shaking such as bumps or an earthquake, and remain stable after any unintentional change in the position with respect to the supporting surface. Other advantages and features of the invention will become apparent from a consideration of the ensuing description and drawings.

FIG. **5*a*** is a side view of the lamp with an irregular base on an irregular surface.

Figure 6:
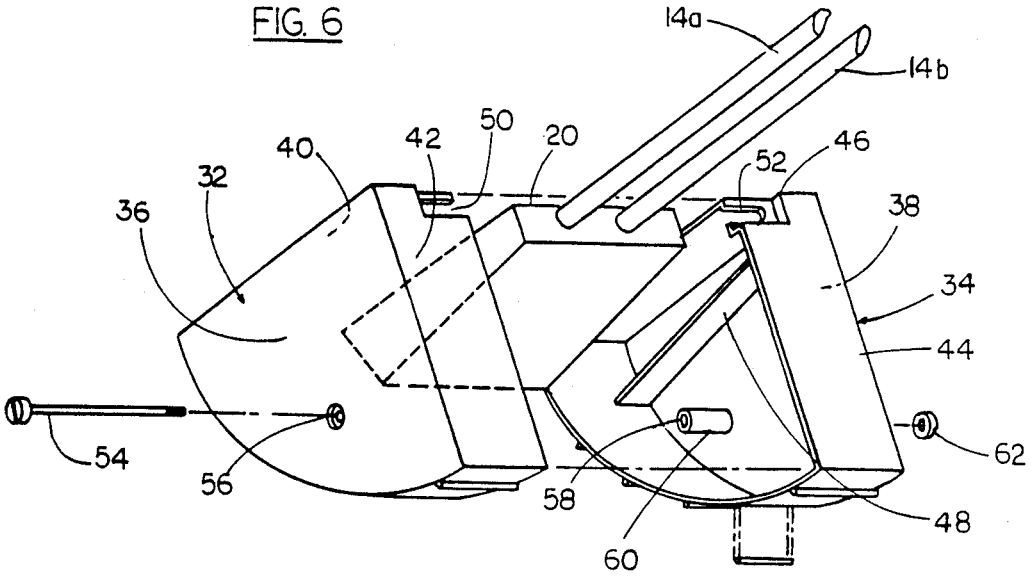

FIG. 6 is a exploded perspective view of the base of the holder in accordance with one embodiment of the invention.

REFERENCE NUMERALS USED IN THE DESCRIPTION AND DRAWINGS

10—holder
12—base
**12*a***—circular support surface of the base
14—arm
16—lamp
18—electric cable
20—counterbalance
22—support or rest surface
**24*a*–24*f***—auxiliary ribs
26—inclined surface
28—base (FIG. 5)
30—non-circular surface of 28
32, 34—sector halves
34, 38—outer face surface of the support
40–46—flat side surfaces of the support
48—partition
50, 52—cuts
54—screw
56, 58—holes
60—guide sleeve
62—nut

Figure 1:
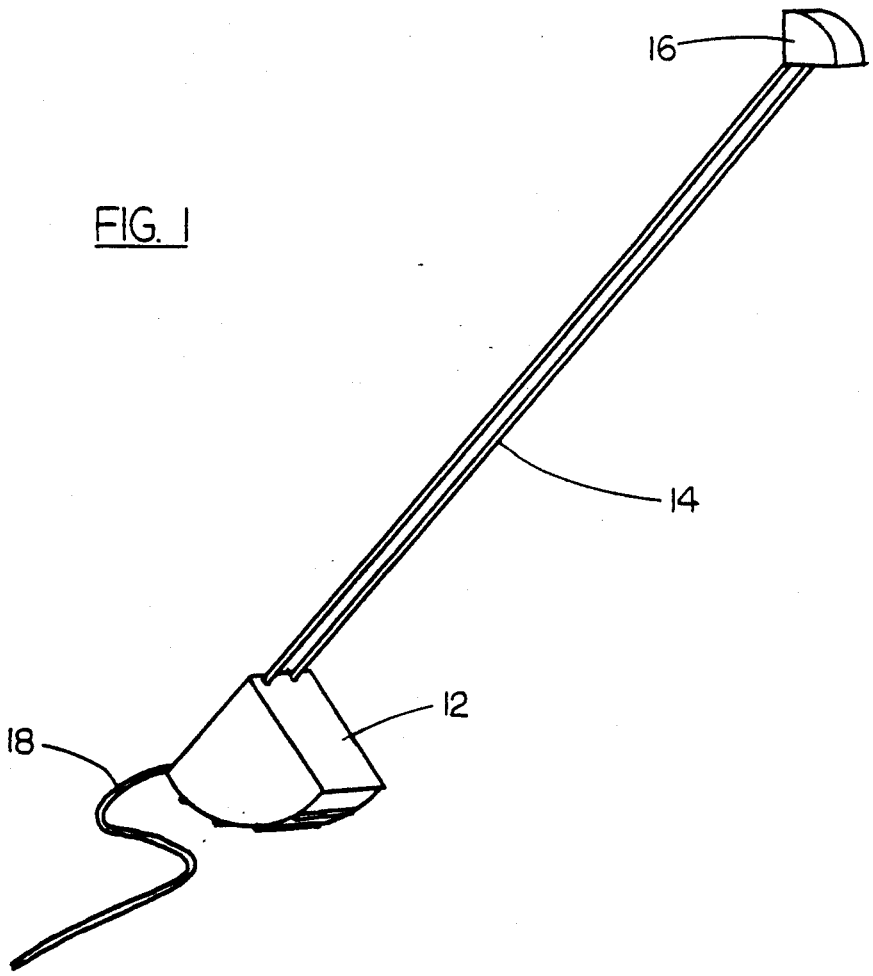
FIG. 1 is a general perspective view of a holder of the invention exemplified in the form of a floor or desk lamp.
Figure 2:
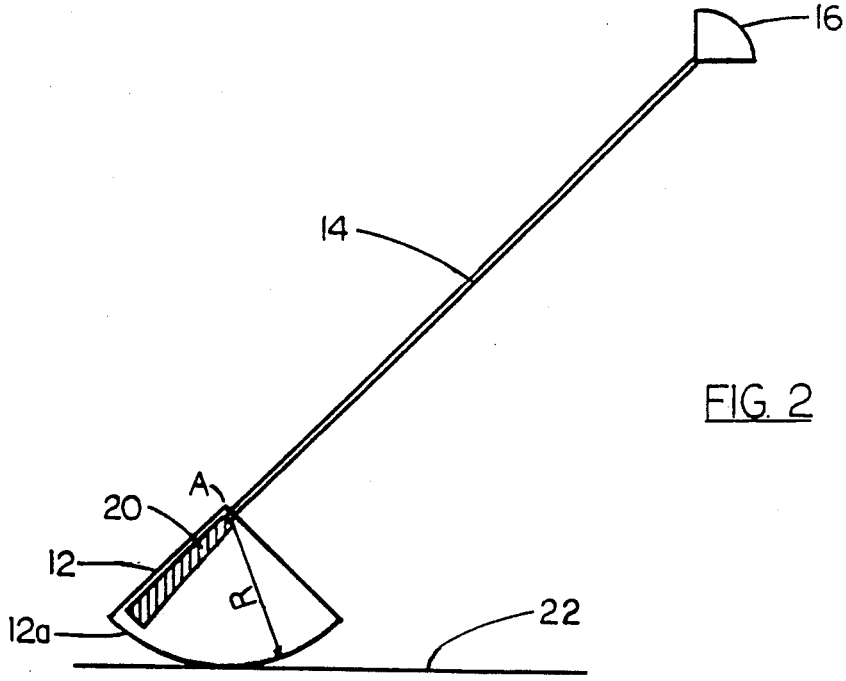
FIG. 2 is a general schematic side view of the lamp; this is used to explain the principle of the invention.
Figure 3:
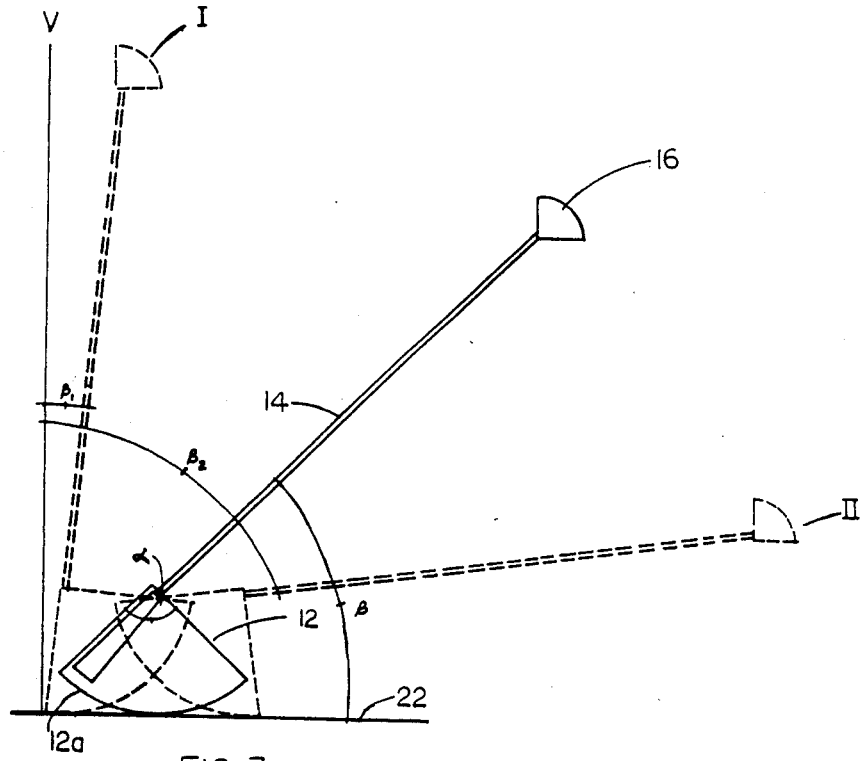
FIG. 3 is a side view of the lamp shown in various balanced positions.

FIGS. 1 and 2—GENERAL DESCRIPTION AND EXPLANATION OF THE PRINCIPLE OF THE INVENTION A general perspective view of a self-balanced holder of the invention is shown in FIG. 1. In this drawing, the holder, which as a whole is designated by reference numeral 10, has an extremely simple construction and consists of a sector-like base 12 and a pair of parallel arms 14. One end of arm pair 14 (hereafter arm 14) is attached to base 12, and the other end carries an object 16 to be supported. Base 12 has a curved bottom and two converging sides which extend from opposite ends of the bottom to meet at a right angle at the top of the base. In the preferred embodiment, object 16 is a lamp which consists of a shade with a lamp bulb (not shown)

therein. An electric cable or cord !8 supplies power to the lamp. As shown in FIG. 3, the lamp can be rolled or rotated into any inclined position within the range of rolling of the curved bottom of base 12 and will remain stable in any selected position within such range.

The principle of the invention will now be explained with reference to FIG. 2, which is a schematic side view of the holder of the invention.

As has been described above, holder 10 consists of sector-like base 12 with a curved bottom or support surface 12*a*, an arm 14, and a lamp 16. Bottom 12*a* is a sector of a circle having a radius R. The center of gravity of holder 10 is located at point A, which is the circular center of bottom 12*a*. In other words, point A is an imaginary pivot point of holder 10. In order to balance the weight of arm 14 and lamp 16, a counterbalancing weight 20 is mounted in base 12, on the other side of point A from lamp 16. Counterbalance 20 is selected so that it and base 12 counterbalances arm 14 and lamp 16. The holder is positioned on a support or rest surface 22, which in the illustrated case is horizontal and may comprise the top surface of a desk or the floor.

Irrespective of the angle of inclination of arm 14, or the concomitant height of lamp 16, point A, the center of gravity of holder 10 will stay at the same height. Thus there will be no net change in potential energy of the holder, regardless of its angle. The lamp will accordingly be able to remain balanced in any inclined position within the range allowed by the circular bottom of base 12. In other words, the balancing forces and thus the moments of rotation developed by the weight of arm 14, lamp 16, counterweight 20, and the rest of base 12 are equal in different positions of the lamp.

Figure 4:
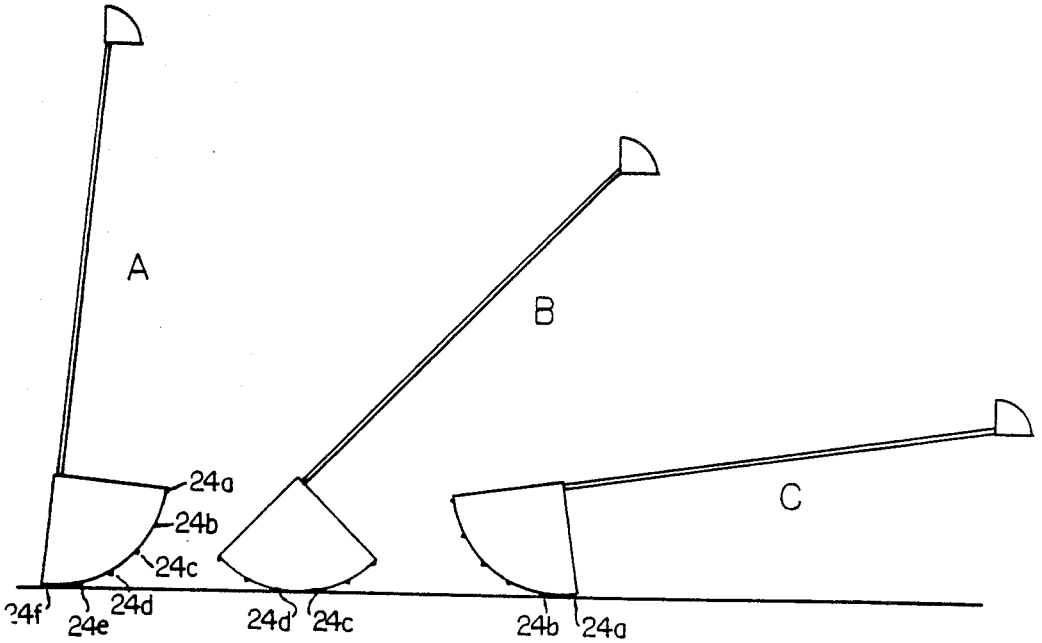
FIG. 4 is a side view of the lamp in various positions with stabilizing ribs on the bottom of its base.

FIGS. 3 and 4—DESCRIPTION AND OPERATION OF THE HOLDER OF THE INVENTION

FIG. 3 is a side view which shows holder 10 in various balanced positions. In this embodiment, bottom surface 12*a* of base 12 is smooth.

In accordance with a preferred embodiment of the invention, the sides of base 12 form a sector angle $\alpha$ of about 90°. This means that the holder can be installed in a wide range of angular positions. At one extreme is an almost vertical position I (angle $\beta_1$ from the vertical line V). Here arm 14 is almost vertical and angle $\beta_1$ is very small. At the other extreme arm 14 is almost horizontal (broken-line position II with angle $\beta_2$ from the vertical, where $\beta_2$ is close to 90°). The holder is shown in full lines in an intermediate position, at an angle $\beta$ from the horizontal.

To adjust lamp 16 to any desired position, one merely needs to rotate or roll entire unit on surface 22 into any inclined position. The unit will remain balanced in this position.

When holder 10 has a smooth circular bottom surface 12*a* (FIG. 3), it will be sufficiently stable to remain in any selected position. However, its stability can be enhanced by providing a plurality of spaced, parallel projections 24*a*–24*f* on circular surface 12*a*, as shown in FIG. 4. Although six such projections are shown, this number can be less or more than six. In view A of FIG. 4 the unit is stabilized by being supported on ribs 24*f* and 24*e* in a position close to vertical. In view B the unit rests on ribs 24*d* and 24*c* and is maintained in an intermediate inclined position. In view C the unit is in a position close to horizontal and rests on ribs 24*b* and 24*a*.

Figure 5:
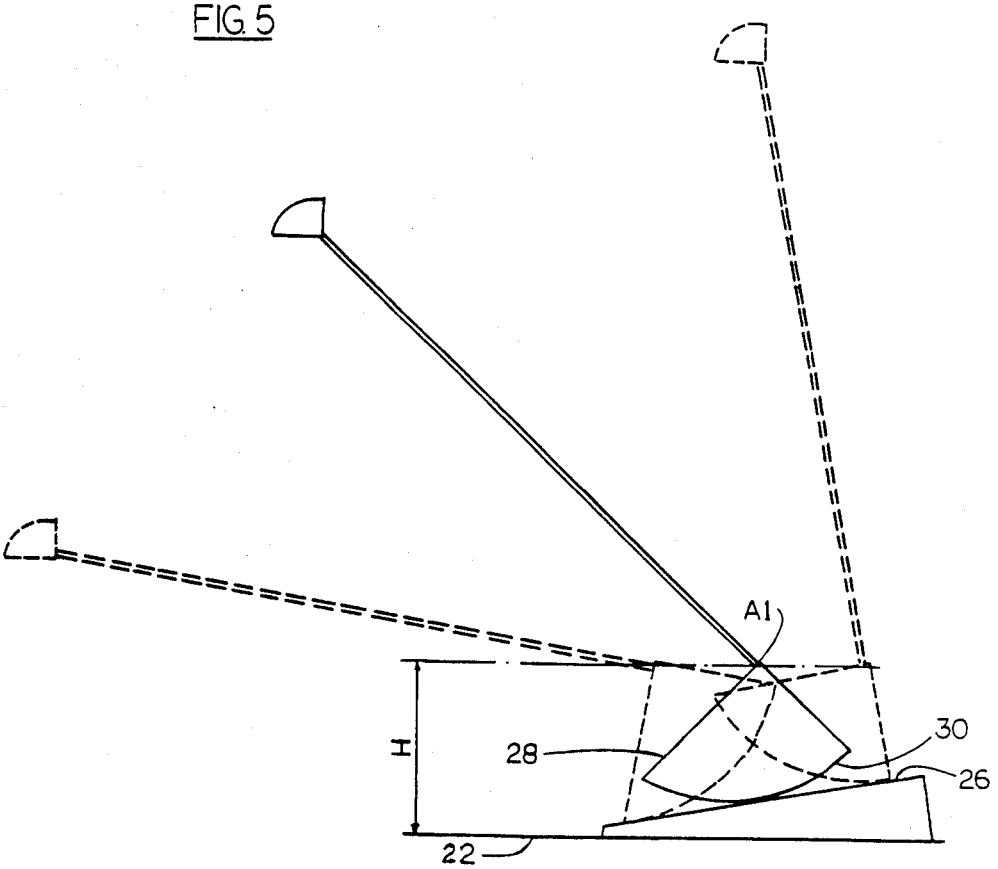
FIG. 5 is a side view of the lamp with a modified base for positioning on an inclined surface.
Figure 5A:
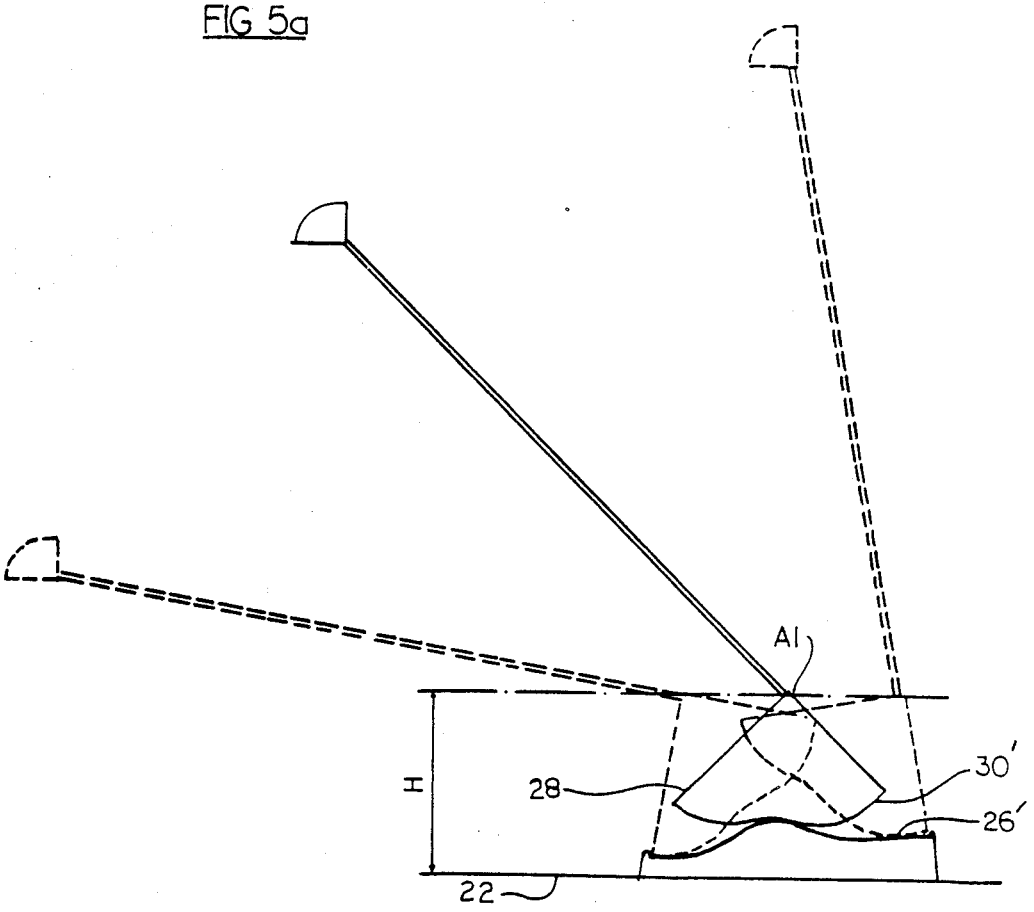

FIGS. 5 and 5*a*—HOLDER ON INCLINED OR IRREGULAR SURFACE

FIG. 5 illustrates another embodiment of the invention, a holder which is designed for use on inclined surfaces, such as surface 26. In order to balance the unit on such inclined surfaces, the bottom of base 28 should have a non-circular surface 30. The profile is such that in various inclined positions of the unit, the center of gravity, point $A_1$, remains on the same height H with respect to an imaginary horizontal support surface 22. The curvature of surface 30 is greater at its upper or right side, where its radius (i.e., right side of base 28) is shorter, and is lesser (straighter) at its lower or left side where its radius is longer. While the left and right sides of base 28 are oriented at a 90° angle, base shapes with greater or smaller angles can be used. Also, other profiles for surfaces 28 and 26 can be used, as shown at 26′ and 30′ of FIG. 5*a*. The height of point $A_1$ should, however, remain constant when the position of the holder is changed. The remaining parts of the construction and operation of the holder of FIGS. 5 and 5*a* are the same as in the previous embodiments. Of course, the auxiliary ribs (not shown) can also be provided on surface 30.

FIG. 6—EXPLODED VIEW

FIG. 6 is an exploded perspective view showing one way base 12 can be constructed. Base 12 consists of two oppositely symmetrical sector halves 32 and 34, which can be molded from plastic. The sector halves comprise a quarter of circle and have flat side surfaces 36 and 38 and two flat end surfaces 40, 42, and 44, 46. Each sector is empty and has on its inner surface a partition 48 (only one of which is shown). End surfaces 42 and 44 have complementary recesses or cutouts 50 and 52.

In an assembled state, counterweight 20 is mounted on the bottom end of arm 14 and is sandwiched between the sector halves so that it appears to be locked between respective partitions (although only one partition 48 is sufficient) and end surfaces 40 and 46.

The halves are screwed together by a screw 54 inserted into a hole 56 in sector half 32. Screw 54 passes through a hole 58 of a guide sleeve 60 formed on the inner side of sector half 34. The end of screw 54 projects from the outer side of sector half 34, and a nut 62 is screwed onto it and locks the entire unit in an assembled state.

In the illustrated embodiment, arm 14 is shown consisting of two tubes or rods 14*a* and 14*b*. One tube can be used for each supply wire, or the two-part wire can be run through one tube. Also, the tubes themselves may be used as separate conductors if they are insulated or if low voltage is used. Two tubes are shown only as an example; a single rod or three or more rods can be used for this purpose. Cutouts 50 and 52 are intended for embracing rods 14*a* and 14*b*. In an assembled state, counterweight 20 will be fixed inside base 12 and thus will not be visible in FIG. 1.

The holder and its parts can be molded from plastic, or can be made from metal, or can be assembled from metal and plastic parts.

In one embodiment, the unit had a total weight of 140 g and a length of 41 cm from the balance point (center of gravity) to lamp 16. Surface 12*a* was 10 cm from the balance point and had a weight of about 570 g. Projections 24 had a height of 1 mm and were 30 mm apart. Base 12 had a width, i.e., a linear dimension from surface 36 to surface 38, of 7 cm. In order to provide a lateral stability, the ratio of the length of the arm to the width of the holder unit should be selected within the range of 1-6 to 1-10 (all parameters are approximate and can be changed as necessary).

SUMMARY, RAMIFICATIONS, SCOPE

Thus the reader will see that the invention provides a self-balanced holder for various objects. The holder is simple in construction, inexpensive to manufacture, free of any moving or pivoting parts, yet can be stably positioned in any desired orientation. It has an attractive, elegant and modernistic appearance. The holder will not fall down in case of occasional shaking such as in case of bumps or an earthquake, and will remain stable after an unintentional change of the position of the base with respect to the supporting surface.

The invention has been shown and described in the form of specific embodiment of a holder for a lamp. However, this specific embodiment, parts, materials and configurations have been given as an example, and many other modifications for a holder as well as for objects supported by the holder are possible.

For example, the holder need not necessarily be used for lamp, but rather as holder for such objects as an advertising sign, a flag, a microphone, etc. Arm 14 can be attached to any point of base 12, other than the center of gravity, provided the weight of the arm and the object is balanced with that of the support and counterweight. Similarly, the counterweight can be located in other place of the base or on its outer side rather than inside.

The auxiliary support ribs can be pivotably attached to the support surface and snapped in a folded or unfolded position. The entire unit, i.e., the sector, counterweight and arm with the lamp shade or an object, can be molded as one integral part, or the base can be assembled from more than two parts, e.g., from three parts. The base may comprise an integral part with a slot for insertion of a counterbalance portion of the arm, which can be maintained in this slot by friction. If necessary, the arm can be adjustable in its length, and the counterweight can be provided with additional removable loads to compensate for variations in the rotation moment of the arm with an object. Thus the scope of the invention should be determined, not only by the examples given, but by the appended claims and their legal equivalents.

I claim:

1. A self-balanced, multiposition holder, comprising:
a base,
an arm having two opposite ends,
one end of said arm being attached to said base,
the opposite end of said arm carrying an object,
said base having a curved bottom surface which allows said holder to rotate on said curved bottom surface when said holder rests on a support surface,
aid base, said arm, and said object being sized, shaped, and weighted so that in any position of rotation of said curved bottom surface on said support surface, within a given range of rotation, said holder will remain balanced,
said base consisting of two oppositely symmetrical parts, at least one of which has on its inner surface a locking element for fixing said counterweight between said parts when said parts are in an assembled condition, and
fixing means for fixing said parts in said assembled condition.

2. The holder of claim 1 wherein said two parts are molded plastic parts, said locking element is a partition molded on the inner surface of at least one of said parts, so that in said assembled condition of said parts, said counterweight can be locked by said partition, and wherein said fixing means comprises a screw and means for guiding said screw through said support when said parts are in said assembled condition.

3. The holder of claim 1 wherein said bottom surface is a noncircular surface which has a profile which maintains said center of gravity of said holder at a constant height with respect to an imaginary horizontal rest surface when said holder is positioned on a surface inclined to a horizontal plane, whereby when said holder is positioned on said inclined surface, it will remain stable in any position, regardless of orientation of said holder within said range of rotation.

4. The holder of claim 1 wherein said object is a lamp.

5. The holder of claim 1 wherein arm consists of two tubular rods.

6. The holder of claim 1 wherein said arm is attached to a counterweight located on the end of said arm opposite to said object, said center of gravity being located at the point of attachment of said counterweight to said arm.

7. The holder of claim 1 wherein said base is a sector of a circle, said center of gravity being located at the center of said circle, said bottom surface being circular.

8. The holder of claim 7 wherein said sector is a quarter of a circle.

9. The holder of claim 7 wherein said curved surface has a plurality of projections for imparting additional stability to said holder on said horizontal rest surface.

10. A self-balanced, multiposition in holder for an object, comprising:
a base,
an arm which has opposite ends,
one end of said arm being attached to said base,
the other end of said arm carrying an object,
said base having a curved bottom surface so that when said bottom surface of said base is placed on a support surface, said entire holder can rotate on said bottom surface of said base within a range of rotation,
said holder having a center of gravity located at a point which has a constant vertical distance from said support surface when said bottom surface of said base is placed onto said support surface, regardless of orientation of said holder within said range of rotation, so that in any rotational orientation of said holder within said range, said holder will be balanced,
said base consisting of two oppositely symmetrical parts, at least one of which has on its inner surface a locking element for fixing said counterweight between said parts when said parts are in an assembled condition, and
fixing means for fixing said parts in said assembled condition.

11. The holder of claim 10 wherein said two parts are molded plastic parts, said locking element is a partition molded on the inner surface of at least one of said parts, so that in said assembled condition of said parts, said counterweight can be locked by said partition, and wherein said fixing means comprises a screw and means for guiding said screw through said support when said parts are in said assembled condition.

12. The holder of claim 10 wherein said bottom surface is a noncircular surface which has a profile which maintains said center of gravity of said holder at a constant height with respect to an imaginary horizontal rest surface when said holder is positioned on a surface inclined to a horizontal plane, whereby when said holder is positioned on said inclined surface, it will remain stable in any position, regardless of orientation of said holder within said range of rotation.

13. The holder of claim 10 wherein said object is a lamp.

14. The holder of claim 10 wherein arm consists of two tubular rods.

15. The holder of claim 10 wherein said arm is attached to a counterweight located on the end of said arm opposite to said object, said center of gravity being located at the point of attachment of said counterweight to said arm.

16. The holder of claim 10 wherein said base is a sector of a circle, said center of gravity being located at the center of said circle, said bottom surface being circular.

17. The holder of claim 16 wherein said sector is a quarter of a circle.

18. The holder of claim 16 wherein said curved has a plurality of projections for imparting additional stability to said holder on said support surface.

19. A self-balanced, multiposition lamp holder comprising a base and an arm having one end attached to said base and carrying a lamp at its opposite end, said base having a circular bottom surface which allows rotation of said circular bottom surface on a surface onto which said holder rests, the center of gravity of said holder being located at a constant vertical distance from said rest surface, so that in any position within a given range, said holder remains balanced, said arm supplying power to said lamp, said arm being attached to a counterweight located on the end of said arm opposite to said object, said center of gravity being located in the point of attachment of said counterweight to said arm, said base consisting of two oppositely symmetrical molded plastic parts, at least one of which has on its inner surface a locking element for fixing said counterweight in an assembled position of said holder between said parts, and fixing means for fixing said parts in said assembled position.

* * * * *